US006841711B2

(12) United States Patent
Krug et al.

(10) Patent No.: US 6,841,711 B2
(45) Date of Patent: Jan. 11, 2005

(54) PROCESS FOR MAKING A LUBE BASE STOCK FROM A LOWER MOLECULAR WEIGHT FEEDSTOCK IN A CATALYTIC DISTILLATION UNIT

(75) Inventors: Russell R. Krug, Novato, CA (US); Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 217 days.

(21) Appl. No.: 09/758,667

(22) Filed: Jan. 11, 2001

(65) Prior Publication Data

US 2001/0006154 A1 Jul. 5, 2001

(51) Int. Cl.[7] ..... C07C 2/08

(52) U.S. Cl. ..... 585/326; 585/329; 585/502; 585/510; 585/517; 585/518; 585/519; 585/520; 585/533; 585/601; 208/18

(58) Field of Search ..... 585/326, 329, 585/502, 510, 517, 518, 519, 520, 533, 601; 208/18; 203/DIG. 6

(56) References Cited

U.S. PATENT DOCUMENTS

| | | | | |
|---|---|---|---|---|
| 2,620,365 A | * | 12/1952 | Anderson | 208/66 |
| 3,852,207 A | | 12/1974 | Stangeland et al. | |
| 3,904,513 A | | 9/1975 | Fischer et al. | |
| 4,157,294 A | | 6/1979 | Iwao et al. | |
| 4,232,177 A | | 11/1980 | Smith, Jr. | 585/324 |
| 4,307,254 A | | 12/1981 | Smith, Jr. | 568/697 |
| 4,308,414 A | * | 12/1981 | Madgavkar et al. | 585/525 |
| 4,336,407 A | | 6/1982 | Smith, Jr. | 568/697 |
| 4,401,556 A | | 8/1983 | Bezman et al. | |
| 4,413,153 A | * | 11/1983 | Garwood et al. | 585/304 |
| 4,417,088 A | | 11/1983 | Miller | 585/533 |
| 4,484,014 A | * | 11/1984 | Nelson et al. | 585/255 |
| 4,523,045 A | | 6/1985 | Vora | |
| 4,523,048 A | | 6/1985 | Vora | |
| 4,527,004 A | * | 7/1985 | Sweeney | 585/851 |

(List continued on next page.)

FOREIGN PATENT DOCUMENTS

| | | | | |
|---|---|---|---|---|
| EP | 225 053 | | 6/1987 | |
| EP | 582 347 | | 2/1994 | |
| EP | 464 546 | | 1/1995 | |
| EP | 659 478 | | 6/1995 | |
| EP | 791 643 | A1 | 2/1997 | |
| EP | 673352 | B1 * | 4/1999 | C07C/2/12 |
| WO | WO 9521872 | A1 * | 8/1995 | C08F/4/52 |
| WO | WO96/13563 | | 5/1996 | |
| WO | WO96/26993 | | 9/1996 | |

OTHER PUBLICATIONS

Dornte, R.W., *Oxidation of White Oils, Industrial and Engineering Chemistry,* Industrial Edition, Jan. 1936, vol. 28, No. 1, Published by American Chemical Society, Easton, PA. pp. 26–30.

Endeby, J.E., *Ionic liquids: recent progress and remaining problems, J. Phys. Condensed Matter,* vol. 5, Supp 34B, pp. B99–B106, Institute of Physics Publishing, U.K. (1993).

Malz Jr., R., *Catalysis of Organic Reactions,* 68, pp. 249–263, Marcel Dekker, Inc., New York, (1996).

Seddon, K.R., *Ionic Liquids for Clean Technology, J. Chem Tech. Biotechnol.,* 68, pp351–356, John Wiley & Sons Ltd., UK, (1997).

*Primary Examiner*—Walter D. Griffin
(74) *Attorney, Agent, or Firm*—Burns, Doane, Swecker & Mathis, L.L.P.

(57) ABSTRACT

A process for making a lube base stock wherein an olefinic feedstock is contacted with an oligomerization catalyst in a catalytic distillation unit to produce a product having a higher number average molecular weight than the olefinic feedstock. That product is separated zone in the catalytic distillation unit into a light byproduct fraction and a heavy product fraction that includes hydrocarbons in a lube base stock range.

15 Claims, 1 Drawing Sheet

U.S. PATENT DOCUMENTS 4,542,251 A 9/1985 Miller ..... 585/533
4,594,172 A * 6/1986 Sie ..... 252/55
4,608,450 A 8/1986 Miller
4,657,661 A 4/1987 Miller
4,678,645 A * 7/1987 Chang et al. ..... 422/190
4,820,402 A 4/1989 Partridge et al.
4,855,524 A 8/1989 Harandi et al. ..... 585/517
4,913,799 A 4/1990 Gortsema et al.
4,935,577 A * 6/1990 Huss et al. ..... 585/726
4,962,249 A 10/1990 Chen et al. ..... 585/329
5,004,862 A * 4/1991 Hildinger et al. ..... 585/867
5,012,021 A 4/1991 Vora et al.
5,015,361 A 5/1991 Anthes et al. ..... 208/111
5,037,528 A * 8/1991 Garwood et al. ..... 208/27
5,049,536 A 9/1991 Bellussi et al.
5,059,567 A 10/1991 Linsten et al.
5,068,476 A * 11/1991 Wu et al. ..... 585/12
5,073,530 A 12/1991 Bezman et al.
5,080,878 A 1/1992 Bowes et al. ..... 423/328
5,082,986 A 1/1992 Miller
5,114,563 A 5/1992 Lok et al.
5,135,638 A 8/1992 Miller
5,146,022 A 9/1992 Buchanan et al. ..... 585/12
5,171,909 A 12/1992 Sanderson et al. ..... 585/255
5,198,203 A 3/1993 Kresge et al.
5,198,597 A 3/1993 O'Young et al.
5,243,112 A 9/1993 Chester et al. ..... 585/12
5,246,566 A 9/1993 Miller
5,246,689 A 9/1993 Beck et al.
5,270,273 A 12/1993 Pelrine et al. ..... 502/60
5,276,229 A 1/1994 Buchanan et al. ..... 585/255
5,282,958 A 2/1994 Santilli et al.
5,334,368 A 8/1994 Beck et al.
5,382,739 A * 1/1995 Atkins et al. ..... 585/530
5,453,556 A * 9/1995 Chang et al. ..... 585/524
5,502,018 A 3/1996 Chauvin et al.
5,550,304 A 8/1996 Chauvin et al.
5,723,716 A 3/1998 Brandes et al.
5,741,759 A 4/1998 Gee et al.
5,866,746 A 2/1999 Didillion et al.
5,965,783 A 10/1999 Gee et al.
6,008,164 A 12/1999 Aldrich et al.
6,025,533 A 2/2000 Vora et al. ..... 585/330

* cited by examiner

PROCESS FOR MAKING A LUBE BASE STOCK FROM A LOWER MOLECULAR WEIGHT FEEDSTOCK IN A CATALYTIC DISTILLATION UNIT

RELATED APPLICATIONS

This application is related to U.S. Pat. No. 6,706,936, "A Process For Making A Lube Base Stock From A Lower Molecular Weight Feedstock," filed concurrently with this application. U.S. Pat. No. 6,706,936 is a continuation-in-part of U.S. Ser. No. 09/470,053, issued as U.S. Pat. No. 6,398,946, titled "A Process For Making A Lube Base Stock From A Lower Molecular Weight Feedstock," filed Dec. 22, 1999. This application is also related to U.S. Pat. No. 6,686,511, "A Process For Making A Lube Base Stock From A Lower Molecular Weight Feedstock Using At Least Two Oligomerization Zones," filed concurrently with this application.

The present invention relates to a process for making a lube base stock in a catalytic distillation unit from materials having lower molecular weights. Included in this invention is a process for making predominately bright stock lube base stock.

BACKGROUND OF THE INVENTION

Combining catalytic reaction and product separation in the same reactor can improve the conversion and selectivity for many equilibrium-limited reactions, reduce capital costs and also enhance catalyst lifetimes.

Traditional catalytic distillation unit (CDU) technology combines a heterogeneous catalytic reaction and product separation in a single reactor. The heterogeneous catalyst acts as distillation packing as well as a catalyst for the reaction. Although the concept of carrying out the reaction and separation in a single reactor is not new, the problem of high-pressure drop when catalyst pellets are placed in a distillation tower has delayed the actual commercial utilization of this technology. A breakthrough came in 1980 when Smith in Texas patented a method of placing catalyst particles in fiberglass bags, which subsequently are rolled in bundles with demister wire in between to provide a void space for vapor flow. This form of catalytic distillation packing is also known as "Texas tea bags." Smith has a number of patents on the application of CDU including the production of methyl-tert-butyl-ether (MTBE) (U.S. Pat. Nos. 4,232,177; 4,307,254; and 4,336,407, which are hereby incorporated by reference for all purposes). The first commercial application of CDU was the production of MTBE by Charter Oil at their Houston, Tex., refinery in 1981. The success of the CDU technology for the production of MTBE has led to great interest in using CDU as a more general reaction technique.

There are a number of advantages of the CDU technology due to the combinations of reactions and distillation in a single column. Indeed, CDU is deemed to play a major role for the chemical and petroleum industry in the 21st century. Some of the major benefits for CDU include a reduction in capital costs, increased conversion for equilibrium limited reactions due to the continual removal of products via distillation, improved product selectivity, improved catalyst lifetime due to the reduction of hot spots and removal of fouling substances from the catalyst, and a reduction in energy costs due to the utilization of reaction heat for vaporization and distillation.

Not all catalytic reactions are suitable for carrying out in the CDU mode. Some of the key requirements for suitable reactions are that distillation must be a practical method of separating the reactants and products, the reaction must proceed at a reasonable rate at the temperature equivalent to the boiling point of the liquid mixture in the column, and the reaction cannot be overly endothermic.

Numerous references teach the oligomerization of olefins. For example, U.S. Pat. No. 6,025,533 to Vora, et al. ("Oligomer Production with Catalytic Distillation") teaches production of heavy oligomers ($C_7$+oligomers) from $C_4$ paraffins and olefins by a combination of dehydrogenation and oligomerization. The process has at least one catalyst bed in the top of a distillation column for separating the oligomerization effluent of the dehydrogenation and oligomerization combination.

U.S. Pat. No. 5,276,229; to Buchanan, et al. ("High VI Synthetic Lubricants From Thermally Cracked Slack Wax") teaches oligomerizing alpha-olefins produced from thermally cracked slack wax.

U.S. Pat. No. 5,015,361 to Anthes, et al. ("Catalytic Dewaxing Process Employing Surface Acidity Deactivated Zeolite Catalysts") teaches oligomerization of propylene in two stages using ZSM-23 and ZSM-5 to form a low pour point, high cloud point product, followed by dewaxing.

U.S. Pat. No. 4,855,524 to Harandi, et al. ("Process For Combining the Operation of Oligomerization Reactors Containing a Zeolite Oligomerization Catalyst") teaches combining the operation of a primary reactor that oligomerizes a $C_{3-7}$ feed to gasoline range hydrocarbons and a high pressure secondary reactor that oligomerizes the effluent of the first reactor to make distillate or lubes.

U.S. Pat. No. 4,678,645 to Chang, et al. ("Conversion of LPG Hydrocarbons to Distillate Fuels or Lubes Using Integration of LPG Dehydrogenation and MOGDL") teaches converting $C_{2-4}$-paraffins to higher hydrocarbons by the combination of catalytic or thermal dehydrogenation of a paraffinic feedstock to produce olefins and conversion of olefins to gasoline and distillate boiling range materials in a low pressure oligomerization catalytic reactor and a high pressure oligomerization catalytic reactor.

A variety of patents disclose catalysts useful for oligomerization. For example, U.S. Pat. No. 5,453,556 to Chang et al. ("Oligomerization Process For Producing Synthetic Lubricants") teaches an oligomerization process using a catalyst having an acidic solid with a Group IVB metal oxide modified with an oxyanion of a Group VIB metal.

U.S. Pat. No. 5,270,273 to Pelrine et al. ("Olefin Oligomerization Catalyst") teaches an olefin oligomerization catalyst having a supported, reduced Group VIB metal oxide on an inorganic support, such as MCM-41.

U.S. Pat. No. 5,243,112 to Chester, et al. ("Lubricant Range Hydrocarbons From Light Olefins") teaches oligomerizing an olefinic feedstock over a medium pore zeolite catalyst (HZSM-22).

U.S. Pat. No. 5,171,909 to Sanderson, et al. ("Synthetic Lubricant Base Stocks From Long-Chain Vinylidene Olefins and Long-Chain Alpha- and/or Internal-Olefins") teaches oligomerization of long-chain olefins using certain acidic montmorillonite clay catalysts.

U.S. Pat. No. 5,146,022 to Buchanan et al ("High VI Synthetic Lubricants From Cracked Slack Wax") teaches oligomerizing with a Lewis acid catalyst a mixture of $C_5$–$C_{18}$ or $C_6$–$C_{16}$ alpha-olefins produced from thermal cracking of slack wax.

U.S. Pat. No. 5,080,878 to Bowes, et al. ("Modified Crystalline Aluminosilicate Zeolite Catalyst and Its Use in the Production of Lubes of High Viscosity Index") teaches oligomerization with a modified zeolite (ZSM-5, ZSM-11, ZSM-12, ZSM-22, ZSM-23, ZSM-35, ZSM-38, or ZSM-48).

U.S. Pat. No. 4,962,249 to Chen, et al. ("High VI Lubricants From Lower Alkene Oligomers") teaches oligomerization of lower olefins with a reduced valence state Group VIB metal oxide on porous support. In one embodiment, a feedstock of lower olefins is contacted with surface deactivated, acidic, medium pore, shape selective metallosilicate catalyst under oligomerization conditions, then reacting the mixture with ethylene in contact with an olefin metathesis catalyst under metathesis conditions, then oligomerizing the metathesis product in contact with a reduced valence state Group VIB metal catalyst on porous support.

U.S. Pat. No. 4,542,251 to Miller ("Oligomerization of Liquid Olefin Over a Nickel-Containing Silicaceous Crystalline Molecular Sieve") teaches oligomerization in the liquid phase using nickel-containing silicaceous crystalline molecular sieve catalysts to produce lube base stock.

U.S. Pat. No. 4,417,088 to Miller ("Oligomerization of Liquid Olefins") teaches oligomerization of liquid olefins using intermediate pore size molecular sieves to produce lube base stock.

EP 791,643 A1 ("Lubricating Oils") teaches a process for the production of lubricating oils having a viscosity index of at least 120 and a pour point of −45 C or less by oligomerizing a feedstock comprising one or more $C_{5-18}$ 1-olefins in the presence of an oligomerization catalyst comprising an ionic liquid.

U.S. Pat. Nos. 4,417,088; 4,542,251; 4,678,645; 4,855,524; 4,962,249; 5,015,361; 5,080,878; 5,146,022; 5,171,909; 5,243,112; 5,270,273; 5,276,229; 5,453,556; and 6,025,533 are hereby incorporated by reference for all purposes.

It would be advantageous to provide a process for oligomerizing olefins to form lube base stocks. The present invention provides such a process.

SUMMARY OF THE INVENTION

The present invention provides a process for making a lube base stock from a lower molecular weight feedstock. The process involves contacting an olefinic feedstock with a boiling point greater than 180 F with an oligomerization catalyst in a catalytic distillation unit to produce a product having a higher number average molecular weight than the olefinic feedstock. The product is separated in the catalytic distillation unit into a light byproduct fraction and a heavy product fraction, wherein the heavy product fraction comprises a lube base stock.

Preferably, the olefinic feedstock has boiling points greater than 258 F, more preferably within the range of from 258 to 1100 F, most preferably within the range of from 258 to 650 F. Preferably, the olefinic feedstock includes less than than 50% olefins by weight, more preferably between 10% and 50% olefins by weight.

A preferred olefinic feedstock is derived from Fischer-Tropsch synthesis. Fischer-Tropsch products tend to include oxygenates, olefins and paraffins. Hydrotreatment to reduce the oxygenates also tends to reduce the olefins, forming a highly paraffinic feedstock. The paraffinic feedstock can be dehydrogenated using conventional techniques, providing a mixture of paraffins, olefins and diolefins. Preferably, at least a portion of the diolefins are removed, for example, by selective hydrogenation.

Preferably, the oligomerization catalyst is an inorganic oxide support or a Group VIII metal on an inorganic oxide support, more preferably a Group VIII metal on a zeolitic support. In one embodiment, the oligomerization catalyst is nickel on ZSM-5. In another embodiment, the oligomerization catalyst comprises an ionic liquid, preferably an acidic ionic liquid.

Preferably, light product depleted in olefin content is withdrawn from the reactor via distillation as olefinic molecules in the feed are depleted by reaction in the oligomerization zone. Removing the light products depleted in olefin content helps to maintain adequate reaction rates.

Promptly withdrawing heavy product as the bottoms product helps to keep lube base oil yield high. When the bright stock grade of lube base oil is desired, these olefinic bottoms can be reintroduced to the top of the catalytic distillation unit, so they can pass through the oligomerization zone again, reacting further, forming the very heavy, very large molecules of bright stock. The heavy product is preferably hydrofinished as a final processing step to assure adequate product stability.

Preferably, the heavy product fraction has a viscosity of greater than 2 cSt at 100 C, a viscosity index of at least 80 and a pour point of less than −10 C. More preferably, the viscosity index is at least 120 and a pour point of less than −20 C. More preferably, the heavy product fraction is separated into at least one of the following fractions:

a) a light lube base stock fraction having a viscosity of from 2 to 7 cSt at 100 C;

b) a heavy lube base stock fraction having a viscosity of from 6 to 20 cSt at 100 C; and c) a bright stock fraction having a viscosity of greater than 180 cSt at 40 C.

Most preferably, the heavy product fraction is a bright stock fraction having a viscosity of greater than 180 cSt at 40 C.

In one embodiment, the light product depleted in olefin content is subjected to dehydrogenation conditions to provide additional olefins, optionally with a selective hydrogenation step to lower the concentration of any diolefins that might be formed. The additional olefins can be recycled as an olefinic feed to the catalytic distillation unit.

BRIEF DESCRIPTION OF THE DRAWINGS

In order to assist the understanding of this invention, reference will now be made to the appended drawings. The drawings are exemplary only and should not be construed as limiting the invention.

DETAILED DESCRIPTION OF THE INVENTION

Figure 1:
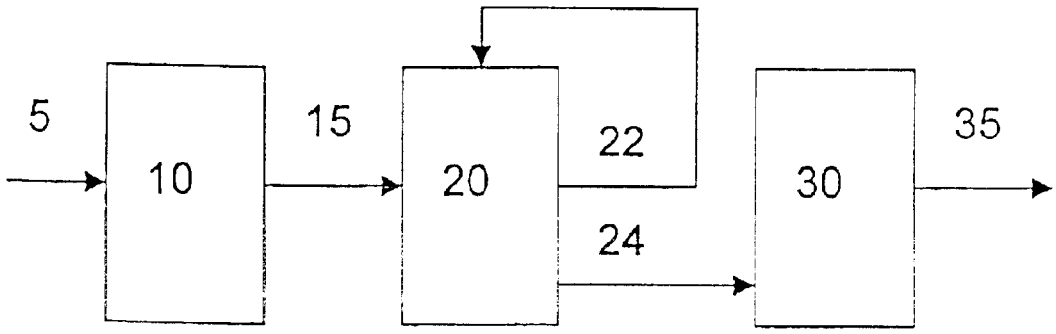
FIG. 1 shows a block diagram of a specific embodiment of a process for making a lube base stock from a lower molecular weight feedstock in a catalytic distillation unit, wherein the production of bright stock is maximized.

In its broadest aspect, the present invention involves a process for forming a lube base stock from an olefinic feedstock with boiling points greater than 180 F. That process has at least two steps. An olefinic feedstock is contacted with an oligomerization catalyst in a catalytic distillation unit to produce a product having a higher number average molecular weight than the olefinic feedstock. The product is then separated in the catalytic distillation unit into a light byproduct fraction and a heavy product fraction. The heavy product fraction comprises a lube base stock.

As used herein the following terms have the following meanings unless expressly stated to the contrary:

The term "catalytic distillation unit" refers to a distillation unit having, within it, at least one catalytic zone. Traditional CDU catalytic zones contain heterogeneous catalysts, although as used herein, homogeneous ionic liquid catalysts, preferably acidic ionic liquid catalysts, can also be used.

The term "heavy product fraction" refers to a heavier fraction of the product from the oligomerization zone, and contains the main product from that zone.

The term "light by-product fraction" refers to a light liquid withdrawn from reflux within the catalytic distillation unit that is substantially depleted of olefins due to reaction in the oligomerization zone.

The term "lube base oil range" refers to initial boiling points of at least 572 F (300 C).

The term "lube base stock" refers to hydrocarbons in the lube base oil range that have acceptable viscosity index and viscosity for use in making finished lubes. Lube base stocks are mixed with additives to form finished lubes.

The term "olefinic feedstock" refers to a feedstock including olefins.

The term "olefinic feedstock with boiling points" refers to an olefinic feedstock wherein at least 80% of the feedstock has the given boiling points. For instance, "an olefinic feedstock having boiling points greater than 180 F" refers to an olefinic feedstock wherein at least 80% of the feedstock has having boiling points greater than 180 F.

The term "oligomerization catalyst" refers to a catalyst that can promote oligomerization.

The term "viscosity index" refers to the measurement defined by D 2270-93.

Unless otherwise specified, all percentages are in weight percent and all molecular weights are number average molecular weights.

Ionic liquids are organic compounds which are charged species, and which are liquid at room temperature. They differ from most salts, in that they have very low melting points. They tend to be liquid over a wide temperature range, are not soluble in non-polar hydrocarbons, are immiscible with water, depending on the anion, and are highly ionizing (but have a low dielectric strength). Ionic liquids have essentially no vapor pressure. Most are air and water stable, and they are used herein to catalyze the oligomerization reaction and/or to solubilize oligomerization catalysts. The properties of the ionic liquids can be tailored by varying the cation and anion. The acidity of the ionic liquids can be adjusted by varying the type of ring and the type of anion used to prepare the ionic liquids. Examples of ionic liquids are described, for example, in *J. Chem. Tech. Biotechnol.*, 68:351–356 (1997); *Chem. Ind.*, 68:249–263 (1996); and *J. Phys. Condensed Matter*, 5:(supp 34B):B99–B106 (1993), the contents of which are hereby incorporated by reference.

As defined above, the term "olefinic feedstock" refers to a feedstock comprising olefins. In the present invention, the boiling points of the olefinic feedstock are greater than 180 F.

Preferably, the olefinic feedstock has boiling points greater than 258 F because one can obtain, by oligomerization, a lube oil using a minimum number of monomers. This simplifies the process and avoids excessive branching in the lube oil, which reduces the viscosity index. More preferably, the boiling points are within the range of from 258 to 1100 F, most preferably within the range of from 258 to 650 F. Since typical lube oil has an initial boiling point above 650 F, oligomerizing molecules which are already in the lube oil boiling range are not usually as preferred as producing lube oil from lower boiling components.

The olefinic feedstock can come from a variety of sources. The following are representative, not exclusive, possibilities.

In one embodiment, the olefinic feedstock is produced, in whole or in part, by dehydrogenating a highly paraffinic feedstock, such as that created by a Fischer Tropsch process. In another embodiment, the olefinic feedstock is produced, in whole or in part, directly from a Fischer Tropsch process, wherein the conditions are adjusted to produce an olefin-rich feedstock. In still another embodiment, the olefinic feedstock is produced by thermally cracking wax from a Fischer Tropsch process, or by thermally cracking diesel or other fuel streams from a Fischer Tropsch process. In still another embodiment, the olefinic feedstock is produced dehydration of alcohols and/or decarboxylation of acids. If desired, more than one source of olefins can be used, and/or other sources can be used besides the ones enumerated above.

Preferred olefinic feedstocks are derived, in whole or in part, from Fischer-Tropsch synthesis. Fischer-Tropsch synthesis may be effected in a fixed bed, in a slurry bed, or in a fluidized bed reactor. The Fischer-Tropsch reaction conditions may include using a reaction temperature of between 190 C and 340 C, with the actual reaction temperature being largely determined by the reactor configuration. Thus, when a fluidized bed reactor is used, the reaction temperature is preferably between 300 C and 340 C; when a fixed bed reactor is used, the reaction temperature is preferably between 200 C and 250 C; and when a slurry bed reactor is used, the reaction temperature is preferably between 190 C and 270 C.

An inlet synthesis gas pressure to the Fischer-Tropsch reactor of between 1 and 50 bar, preferably between 15 and 50 bar, may be used. The synthesis gas may have a $H_2$:CO molar ratio, in the fresh feed, of 1.5:1 to 2.5:1, preferably 1.8:1 to 2.2:1. The synthesis gas typically includes 0.1 wppm of sulfur or less. A gas recycle may optionally be employed to the reaction stage, and the ratio of the gas recycle rate to the fresh synthesis gas feed rate, on a molar basis, may then be between 1:1 and 3:1, preferably between 1.5:1 and 2.5:1. A space velocity, in $m^3$ (kg catalyst)$^{-1}$hour$^{-1}$, of from 1 to 20, preferably from 8 to 12, may be used in the reaction stage.

In principle, an iron-based, a cobalt-based or an iron/cobalt-based Fischer-Tropsch catalyst can be used in the Fischer-Tropsch reaction stage. The iron-based Fischer-Tropsch catalyst may include iron and/or iron oxides which have been precipitated or fused. However, iron and/or iron oxides which have been sintered, cemented, or impregnated onto a suitable support can also be used. The iron should be reduced to metallic Fe before the Fischer-Tropsch synthesis. The iron-based catalyst may contain various levels of promoters, the role of which may be to alter one or more of the activity, the stability, and the selectivity of the final catalyst.

Preferred promoters are those influencing the surface area of the reduced iron ("structural promoters"), and these include oxides or metals of Mn, Ti, Mg, Cr, Ca, Si, Al, or Cu or combinations thereof.

Preferably, when a highly paraffinic feedstock is used to prepare the olefinic feedstock, the paraffinic feedstock is purified (e.g., hydrotreated) to remove oxygenates and other impurities. Other treatments useful for removing oxygenates and other impurities include, but are not limited to, adsorption (e.g., with an acid clay), and extraction.

Preferably, the highly paraffinic feedstock is also dehydrated and decarboxylated to convert alcohols or acids which may be present to olefins. Dehydroxylation and decarboxylation of alcohols and acids are well known. Both reactions can be effected by processing the feedstock over a catalyst, typically alumina, under moderate temperatures and pressures. The reaction of linear alcohols yields predominantly linear olefins and, and acids yield paraffins and carbon dioxide. The water and carbon dioxide can be removed from the reaction mixture, for example, by distillation.

Hydrogenation catalysts can be used for the purification. For example, a noble metal from Group VIIIA according to the 1975, rules of the International Union of Pure and Applied Chemistry, such as platinum or palladium on an alumina or siliceous matrix, or unsulfided Group VIIIA and Group VIB, such as nickel-molybdenum or nickel-tin on an alumina or siliceous matrix, is a suitable catalyst. U.S. Pat. No. 3,852,207 to Stangeland et al. ("Production of Stable Lubricating Oils By Sequential Hydrocracking and Hydrogenation") describes a suitable noble metal catalyst and mild conditions. Other suitable catalysts are detailed, for example, in U.S. Pat. No. 4,157,294 to Iwao, et al. ("Method of Preparing Base Stocks For Lubricating Oil"), and U.S. Pat. No. 3,904,513 to Fischer et al. ("Hydrofinishing or Petroleum"). The non-noble metal (such as nickel-molybdenum) hydrogenation metal are usually present in the final catalyst composition as oxides, or more preferably or possibly, as sulfides when such compounds are readily formed from the particular metal involved. Preferred non-noble metal overall catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalysts contain in excess of 0.01% metal, preferably between 0.1 and 1.0% metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e.; molybdenum and tungsten can be combined with the refractory oxide by impregnation, co-mulling or co-precipitation. Although these components can be combined with the catalyst matrix as the sulfides, that is generally not the case. They are usually added as a metal salt, which can be thermally converted to the corresponding oxide in an oxidizing atmosphere or reduced to the metal with hydrogen or other reducing agent. If necessary, the non-noble metal composition can then be sulfided by reaction with a sulfur donor such as carbon bisulfide, hydrogen sulfide, hydrocarbon thiols, elemental sulfur, and the like.

The matrix component can be of many types including some that have acidic catalytic activity. Ones that have activity include amorphous silica-alumina or may be a zeolitic or non-zeolitic crystalline molecular sieve. Examples of suitable matix molecular sieves include zeolite Y, zeolite X and the so called ultra stable zeolite Y and high structural silica:alumina ratio zeolite Y such as for example described in U.S. Pat. No. 4,401,556 to Bezman, et al. ("Midbarrel Hydrocracking"), U.S. Pat. No. 4,820,402 to Partridge, et al., ("Hydrocracking Process With Improved Distillate Selectivity With High Silica Large Pore Zeolites"), and U.S. Pat. No. 5,059,567 to Listen, et al. ("Process For The Preparation of A Modified Zeolite"). Small crystal size zeolite Y, such as described in U.S. Pat. No. 5,073,530 to Bezman, et al. ("Hydrocracking Catalyst And Process") can also be used. Non-zeolitic molecular sieves which can be used include, for example silicoaluminophosphates (SAPO), ferroaluminophosphate, titanium aluminophosphate and the various ELAPO molecular sieves described in U.S. Pat. No. 4,913,799 to Gortsema, et al. ("Hydrocracking Catalysts And Processes Employing Non-Zeolitic Molecular Sieves") and the references cited therein. Details regarding the preparation of various non-zeolite molecular sieves can be found in U.S. Pat. No. 5,114,563 to Lok, et al. ("Hydrocarbon Conversions Using Catalysts Silicoaluminophosphates"); and in U.S. Pat. No. 4,913,799. Mesoporous molecular sieves can also be included, for example the M41S family of materials, MCM-41 (U.S. Pat. No. 5,246,689 to Beck, et al. ("Synthetic Porous Crystalline Material Its Synthesis And Use"), U.S. Pat. No. 5,198,203 to Kresge, et al. ("Synthetic Mesoporous Crystalline Material"), and U.S. Pat. No. 5,334,368 to Beck, et al. ("Synthesis of Mesoporous Oxide")), and MCM-48.

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides naturally occurring clays which can be composited with the catalyst include those of the montmorillonite and kaolin families. These clays can be used in the raw state as originally mined or initially subjected to calumniation, acid treatment, or chemical modification.

Furthermore more than one catalyst type may be used in the reactor. The different catalyst types can be separated into layers or mixed.

Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300 F to about 750 F, preferably ranging from 450 F to 600 F.

If it is desirable to introduce skeletal isomerization during the paraffinic feedstock hydrotreating step, or during the hydrotreating of the product from the oligomerization reactor, or during the hydrotreating of the final lube base oil range hydrocarbons, the matrix of the catalyst is chosen to facilitate this reaction. Detailed descriptions of catalysts that do this reaction are shown in U.S. Pat. Nos. 5,282,958; 5,246,566; 5,135,638 and 5,082,986 referred to in the Background of the Invention section. A molecular sieve is used as one component in the matrix. The sieve has pores of less than 7.1 Å, preferably less than 6.5 Å; and having at least one pore diameter greater than 4.8 Å, and having a crystal size no more than about 0.5 microns. The catalyst is further characterized in that it has sufficient acidity to convert at least 50% of hexadecane at 370 C, and exhibits a 40 or greater isomerization selectivity ratio as defined in U.S. Pat. No. 5,282,958 at 96% hexadecane conversion. Specific examples of molecular sieves which satisfy these requirements are ZSM-12, ZSM-21, ZSM-22, ZSM-23, ZSM-35, ZSM-38, ZSM-48, ZSM-57, SSZ-32, SSZ-35, Ferrierite, L-type zeolite, SAPO-11, SAPO-31, SAPO-41, MAPO-11 and MAPO-31.

U.S. Pat. Nos. 3,852,207; 3,904,513; 4,157,294; 4,401,556; 4,820,402; 4,913,799; 5,059,567; 5,073,530; 5,114,

563; 5,198,203; 5,246,689; and 5,334,368 are hereby incorporated by reference for all purposes.

Purification of the Feedstock by Adsorption

An adsorption step may be employed to remove nitrogenous species from the paraffinic (and/or olefinic) feed. It is preferred that the concentration of organic nitrogen in the feed to the oligomerization step in the present process be less than about 40 ppm, preferably less than about 20 ppm. Suitable adsorbents to remove the nitrogen compounds include heterogeneous acid materials such as acidic clays, molecular sieves, and ion exchange resins. Such materials are described in U.S. Pat. No. 4,657,661 to Miller ("Process For Improving The Storage Stability And Bulk Oxidation Stability Of Lube Base Stocks Derived From Bright Stock"), hereby incorporated by reference for all purposes.

The Dehydrogenation Reaction

A highly paraffinic feedstock such as that derived from Fischer-Tropsch synthesis can be dehydrogenated to produce the olefinic feedstock. Dehydrogenation processes known in the art generally have employed catalysts which comprise a noble metal, usually Pt, supported on a non-acid support, typically alumina, silica, or non-acidic alumino silicate. The temperature at which paraffin dehydrogenation is normally carried out is in a range from 350 to 650 C (preferably from 400 to 550 C). The process is usually carried out at atmospheric pressure, although it is possible to operate at a pressure of several atmospheres, for example up to 10 atmospheres.

The linear paraffins are generally fed at a rate of from 0.001 to 100 volumes (calculated as a liquid) per hour for each volume of catalyst. Moreover, since the dehydrogenation reaction takes place in the presence of hydrogen gas, it is convenient to maintain the molar ratio of hydrogen to linear paraffin in the feed mixture at a value of from 1:1 to 50:1.

In order to reduce or eliminate the amount of diolefins produced or other undesired byproducts the reaction conversion to olefins in the olefinic feedstock should preferably not exceed 50% and more preferably should not exceed 30% based on the linear hydrocarbon content of the feed. Preferably, the minimum conversion is at least 10% and more preferably at least 20%.

Skeletal isomerization of the paraffinic feedstock, of the olefinic feedstock, or of the final product can be used to control the pour and cloud point of the final product to the desired value. Preferably, this skeletal isomerization is induced prior to the oligomerization zone.

Skeletal isomerization is preferred before oligomerization because, if isomerization is required to meet pour point requirements, it is easier to isomerize the lower molecular weight components to the oligomerization step than the high molecular weight oligomer. This will result in a higher yield of lube oil, since the cracking and yield loss trying to isomerize the oligomer can thus be avoided.

If it is desired to induce skeletal isomerization of the olefinic feedstock, U.S. Pat. No. 5,741,759 to Gee, et al. ("Skeletally Isomerized Linear Olefins") and U.S. Pat. No. 5,965,783 to Gee, et al. ("Process For Isomerizing Olefins") describe catalysts and process conditions to do this. Molecular sieves as defined above in the paraffin skeletal isomerization step may be used as catalyst, however metals, such as noble metals, are excluded from the catalyst formulation. The molecular sieve is frequently composited with a binder to form an extrudate, sphere, or pellet. Temperatures used to skeletally isomerize the olefins are between 100 and 400 C, the WHSV is between 0.2 and 10, and the pressure is typically below 500 psig, preferably below 100 psig.

Skeletal isomerization can be carried out simultaneously with dehydrogenation by using a catalyst with an acidic isomerization function in combination with a catalyst with a dehydrogenation function. These catalytic functions can be on separate particles with the particles either mixed or in layers, or on the same particle. Examples of catalysts which carry out both isomerization and dehydrogenation include Group VIII metals on acidic amorphous supports, such as taught in U.S. Pat. No. 5,866,746 to Didillion, et al. ("Catalytic Dehydroisomerization of $C_4$–$C_5$ N-Paraffins"), and metals on zeolitic supports, such as taught in U.S. Pat. No. 5,198,597 to O'Young, et al. ("Bimetallic Catalysts For Dehydroisomerization of N-Butane to Isobutene").

If skeletal isomerization is not induced during hydrotreatment of the highly paraffinic feedstock or during dehydrogenation, these olefins inherently are usually predominately internal olefins.

Preferably, any diolefins produced during the dehydrogenation are removed by known adsorption processes or selective hydrogenation processes that selectively hydrogenate diolefins to monoolefins without significantly hydrogenating monoolefins. Suitable selective hydrogenation processes for hydrotreating diolefins to monoolefins without hydrogenating monoolefins are, for example, described in U.S. Pat. No. 4,523,045 to Vora ("Process For Converting Paraffins To Olefins"); in U.S. Pat. No. 4,523,048 to Vora ("Process For The Selective Production of Alkylbenzenes"); and U.S. Pat. No. 5,012,021 to Vora, et al. ("Process For The Production of AlkylAromatic Hydrocarbons Using Solid Catalysts"). If desired, branched hydrocarbons may be removed before or after the dehydrogenation process, typically by adsorption.

U.S. Pat. Nos. 4,523,045; 4,523,048; 5,012,021; 5,198,597; 5,741,759; 5,866,746; and 5,965,783 are hereby incorporated by reference for all purposes.

The olefinic feedstock is contacted with an oligomerization catalyst in a catalytic distillation unit to produce a product having a higher number average molecular weight than initial feedstock. Preferably, the product has a higher number average molecular weight at least 10% higher than the initial feedstock, more preferably at least 20% higher than the initial feedstock.

Conditions for the oligomerization reaction in a catalytic distillation unit are typically between room temperature and 400 F, from 0.1 to 3 LHSV, and from 0 to 500 psig. Suitable catalysts for oligomerization include virtually any acidic material, for example, zeolites, clays, resins, $BF_3$ complexes, HF, $H_2SO_4$, $AlCl_3$, ionic liquids (preferably acidic ionic liquids), superacids, etc. Preferably, the catalyst is an inorganic oxide support or a Group VIII metal on an inorganic oxide support. More preferably a Group VIII metal on a zeolite support. Zeolites are preferred because of their resistance to fouling and ease of regeneration. In one embodiment, the catalyst is nickel on ZSM-5. Suitable catalysts and conditions for conducting olefin oligomerization reactions are well known to those of skill in the art, and described, for example, in U.S. Pat. Nos. 4,417,088, 4,542,251, and 5,965,783, which are hereby incorporated by reference for all purposes.

The catalytic distillation unit also separates any product formed into a light byproduct fraction and a heavy product fraction, wherein the heavy product fraction comprises a lube base stock. Product separation is carried out in a catalytic distillation unit and may advantageously use refinery capacity made surplus by prohibitions against TAME and MTBE in gasoline. Preferably, portions of the light by-product fraction and the heavy product fraction are refluxed to the catalytic distillation unit.

The heavy product fraction includes predominately hydrocarbons in the lube base oil range that have acceptable viscosity index and viscosity for use in making finished lubes (lube base stock). Preferably, the heavy product fraction has a viscosity of greater than 2 cSt at 100 C and a viscosity index of at least 80 (more preferably at least 120). A viscosity index of at least 120 is preferred over a viscosity of at least 80 because the higher VI oil will maintain its viscosity to a greater degree over a range of temperatures (the definition of VI). The higher VI oil will likely have higher oxidation stability. Preferably, the pour point is less than −10 C, more preferably less than −20 C.

Distillation bottoms can be discarded (e.g., if any solids are present), or they can be kept for subsequent processing to form finished lube base stock.

Preferably, the heavy product fraction is separated into at least one of the following fractions:

a) a light lube base stock fraction having a viscosity of from 2 to 7 cSt at 100 C;

b) a heavy lube base stock fraction having a viscosity of from 6 to 20 cSt at 100 C; and c) a bright stock fraction having a viscosity of greater than 180 cSt at 40 C.

The specifications for lube base stocks are defined in the API Interchange Guidelines (API Publication 1509). Group II base stocks have no more than 300 ppm sulfur, have at least 90% saturates, and have viscosity indexes of from 80 less than 120. Group II base stock constitutes about 10% of the world lube base'stock production, and approximately 30% of the U.S. production.

To form Group II stocks, preferably the heavy product fraction is separated into at least one of the following fractions:

a) a light lube base stock fraction having a viscosity of from 3 to 6 cSt at 100 C, more preferably from 3.5 to 5 cSt, most preferably from 3.8 to 4.2 cSt;

b) a heavy lube base stock fraction having a viscosity of from 6 to 16 cSt at 100 C, more preferably from 9 to 13 cSt, most preferably from 11 to 12.5 cSt; and c) a bright stock fraction having a viscosity of greater than 180 cSt at 40 C, more preferably greater than 220, most preferably greater than 250 cSt.

Group III base stocks have no more than 300 ppm sulfur, have at least 90% saturates, and have viscosity indexes of 120 or more. Only a small fraction of the lube base stock production in the world is Group III base stock. To form these Group III stocks, preferably the heavy product fraction is separated into at least one of the following fractions:

a) a light lube base stock fraction having a viscosity of from 3 to 7 cSt at 100 C, more preferably from 4 to 6 cSt, most preferably from 4.7 to 5.3 cSt;

b) a heavy lube base stock fraction having a viscosity of from 7 to 20 cSt at 100 C, more preferably from 10 to 15 cSt, most preferably from 12 to 13.5 cSt; and c) a bright stock fraction having a viscosity of greater than 180 cSt at 40 C, more preferably greater than 220, most preferably greater than 250 cSt.

The split between the light by-product fraction and the heavy product fraction can be adjusted, along with the amount of recycle, to control the viscosity grade distribution of lube products made. In one particularly preferred embodiment, the separation of fractions is adjusted so that the heavy product fraction is mainly a bright stock fraction. In that embodiment, most of the light by-product fraction is recycled to the oligomerization zone.

Preferably, the heavy product fraction is hydrofinished to eliminate any remaining olefins. More preferably, the heavy product fraction is hydrogenated to remove any remaining olefins. Conditions for hydrofinishing hydrocarbons are well known to those of skill in the art, Typical conditions are between 200 and 600 F, 0.1 to 3 LHSV, and 200 to 3000 psig. Catalysts useful for the hydrofinishing reaction can be any NiMo supported catalyst or a Group VIII metal on a support. Preferred catalysts are platinum, palladium, or platinum-palladium alloys.

Conventional cloud point reduction processes can be used to adjust the cloud point. These processes can be performed either before hydrofinishing in a separate reactor, by isomerizing the olefinic oligomer, or in the same reactor with the hydrofinishing catalyst. Conditions for isomerizing oligomers are well known to those of skill in the art, and are described, for example, in U.S. Pat. Nos. 5,082,986 and 5,965,783. For example, U.S. Pat. No. 5,082,986 discloses a process for forming a $C_{20}$+ lube oil from olefins or reducing the pour point of a lube oil by isomerizing the olefins over a catalyst that includes an intermediate pore size silicoaluminophosphate molecular sieve and at least one Group VIII metal.

EXAMPLES

The invention will be further illustrated by following examples, which set forth particularly advantageous method embodiments. While the Examples are provided to illustrate the present invention, they are not intended to limit it.

In one specific embodiment, as shown in FIG. 1, an olefinic feedstock 5, with boiling points within the range of from 258 to 650 F, and with an olefin content of from 10% to 50%, is selectively hydrogenated in a selective hydrogenation zone 10 to saturate at least a portion of any diolefins present while not saturating most of any monoolefin present, producing a selectively hydrogenated olefinic feedstock 15. This selectively hydrogenated olefinic feedstock 15 is contacted with an oligomerization catalyst in a catalytic distillation unit 20 to produce a product having a number average molecular weight at least 20% higher than the olefinic feedstock. That product is separated in the catalytic distillation unit 20 into a light byproduct fraction 22 and a heavy product fraction 24, wherein the heavy product fraction includes a lube base stock with a viscosity of greater than 2 cSt at 100 C, a viscosity index of above 80 and a pour point of less than −10 C. Most of the light byproduct fraction 22 is recycled to the catalytic distillation unit 20. The heavy product fraction 24 is hydrofinished in hydrofinishing zone 30 to produce a hydrofinished lube base stock 35.

While the present invention has been described with reference to specific embodiments, this application is intended to cover those various changes and substitutions that may be made by those skilled in the art without departing from the spirit and scope of the appended claims.

What is claimed is:

1. A process for making a lube base stock comprising:

a) obtaining a diolefin-containing olefinic feedstock with boiling points within the range of from 258° to 650° F. and including between 10% and 50% olefins;

b) inducing skeletal isomerization of the diolefin-containing olefinic feedstock, producing a skeletally isomerized diolefin-containing olefinic feedstock;

c) selectively hydrogenating the skeletally isomerized diolefin-containing olefinic feedstock to saturate at least a portion of any diolefins present while not saturating most of the mono-olefins present, producing a selectively hydrogenated skeletally isomerized diolefin-containing olefinic feedstock;

d) contacting said selectively hydrogenated skeletally isomerized diolefin-containing olefinic feedstock with an oligomerization catalyst in a catalytic distillation unit having, within it, at least one catalytic zone to produce a product having a number average molecular weight at least 20% higher than the olefinic feedstock;

e) separating said product in said catalytic distillation unit into a light by-product fraction and a heavy product fraction, wherein said heavy product fraction comprises hydrocarbons in the lube base stock range with a viscosity of greater than 2 cSt at 100° C., a viscosity index of above 80 and a pour point of less than −10° C.;

f) withdrawing nonolefinic portions of feedstock from the catalytic zone; and g) hydrofinishing said heavy product fraction.

2. The process of claim 1, wherein at least a portion of the diolefin-containing olefinic feedstock is derived from Fischer-Tropsch synthesis.

3. The process of claim 1, wherein the oligomerization catalyst comprises an acidic ionic liquid.

4. The process of claim 3, wherein the acidic ionic liquid catalyst is withdrawn continuously from the catalytic distillation unit, continuously regenerated outside the catalytic distillation unit, and then continuously reintroduced to the catalytic zone at the same rate as withdrawal.

5. The process of claim 1, wherein said oligomerization catalyst comprises an inorganic oxide support.

6. The process of claim 5, wherein said oligomerization catalyst comprises a Group VIII metal on an inorganic oxide support.

7. The process of claim 6, wherein said inorganic oxide support is a zeolitic support.

8. The process of claim 7, where in said oligomerization catalyst is nickel on ZSM-5.

9. The process of claim 1, wherein a light liquid is withdrawn from reflux within said catalytic distillation unit, providing the light by-product fraction.

10. The process of claim 9, wherein at least a portion of the light by-product fraction is continuously sent to an olefin forming reactor, providing an olefinic fraction that is recycled to be used as at least a portion of the diolefin-containing olefinic feedstock of step a).

11. The process of claim 1, wherein excess nonolefinic portions of the diolefin-containing olefinic feedstock are continuously removed from the catalytic zone.

12. The process of claim 1, wherein said heavy product fraction has a viscosity index of at least 120 and a pour point of less than −20° C.

13. The process of claim 1, wherein said heavy product fraction is separated into at least one of the following fractions:

a) a light lube base stock fraction having a viscosity of from 2 to 7 cSt at 100° C.;

b) a heavy lube base stock fraction having a viscosity of from 6 to 20 cSt at 100° C.; and c) a bright stock fraction having a viscosity of greater 180 cSt at 40° C.

14. The process of claim 1 wherein, said heavy product fraction is predominately a bright stock fraction having a viscosity of greater than 180 cSt at 40° C.

15. The process of claim 1, wherein said heavy product fraction has an initial boiling point of at least 572° F.

* * * * *